US008851833B2

(12) United States Patent
Diamond et al.

(10) Patent No.: US 8,851,833 B2
(45) Date of Patent: Oct. 7, 2014

(54) BLADES

(75) Inventors: Stephen C. Diamond, Derby (GB); Caner H. Helvaci, Derby (GB); Roderick M. Townes, Derby (GB); Ian Tibbott, Litchfield (GB); Dougal R. Jackson, Stanton-by-Bridge (GB)

(73) Assignee: Rolls-Royce PLC, London (GB)

( * ) Notice: Subject to any disclaimer, the term of this patent is extended or adjusted under 35 U.S.C. 154(b) by 814 days.

(21) Appl. No.: 13/053,928

(22) Filed: Mar. 22, 2011

(65) Prior Publication Data

US 2011/0255985 A1 Oct. 20, 2011

(30) Foreign Application Priority Data

Apr. 19, 2010 (GB) ..... 1006449.1

(51) Int. Cl.
*F01D 11/08* (2006.01)
*F01D 5/20* (2006.01)

(52) U.S. Cl.
CPC ..... *F01D 5/20* (2013.01)
USPC ..... 415/168.2; 415/173.1

(58) Field of Classification Search
USPC ..... 415/168.2, 173.1, 173.3, 173.6; 416/194, 195, 196 R, 189, 228
See application file for complete search history.

(56) References Cited

U.S. PATENT DOCUMENTS

| | | | | |
|---|---|---|---|---|
| 2,801,790 | A * | 8/1957 | Doll, Jr. | 415/210.1 |
| 6,142,739 | A | 11/2000 | Harvey | |
| 6,338,609 | B1 * | 1/2002 | Decker et al. | 415/173.1 |
| 7,632,062 | B2 * | 12/2009 | Harvey et al. | 415/115 |
| 2003/0059309 | A1 * | 3/2003 | Szucs et al. | 416/228 |
| 2003/0223870 | A1 * | 12/2003 | Keith et al. | 416/97 R |
| 2005/0106030 | A1 * | 5/2005 | Bachofner et al. | 416/235 |
| 2005/0232771 | A1 * | 10/2005 | Harvey et al. | 416/97 R |
| 2008/0089783 | A1 * | 4/2008 | Addis | 415/170.1 |
| 2008/0118363 | A1 * | 5/2008 | Lee et al. | 416/232 |
| 2009/0123292 | A1 * | 5/2009 | Gu et al. | 416/97 R |
| 2009/0129934 | A1 * | 5/2009 | Gu | 416/97 R |
| 2009/0162200 | A1 * | 6/2009 | Tibbott et al. | 416/91 |
| 2011/0188999 | A1 * | 8/2011 | Braun et al. | 415/170.1 |

FOREIGN PATENT DOCUMENTS

| | | | |
|---|---|---|---|
| EP | 1 529 962 | A2 | 5/2005 |
| EP | 1 882 817 | A2 | 1/2008 |
| EP | 2 161 412 | A2 | 3/2010 |
| GB | 2 413 160 | A | 10/2005 |
| SU | 779591 | | 11/1980 |

OTHER PUBLICATIONS

Harvey et al., "A Computational Study of a Novel Turbine Rotor Partial Shroud," *Transactions of the ASME*, Jul. 2001, pp. 534-543, vol. 123, ASME.

Harvey et al., "An Investigation Into a Novel Turbine Rotor Winglet. Part 1: Design and Model Rig Test Results," *Proceedings of GT2006, ASME Turbo Expo 2006: Power for Land, Sea and Air*, May 8-11, 2006, pp. 1-12, Barcelona, Spain, ASME.

Willer et al., "An Investigation Into a Novel Turbine Rotor Winglet. Part 2: Numerical Simulation and Experimental Results," *Proceedings of GT2006, ASME Turbo Expo 2006: Power for Land, Sea and Air*, May 8-11, 2006, pp. 1-9, Barcelona, Spain, ASME.

Search Report for priority British Patent Application No. 1006449.1, dated Jul. 19, 2010.

European Search Report for corresponding European Patent Application No. 11159160, dated Apr. 26, 2011.

* cited by examiner

*Primary Examiner* — Edward Look
*Assistant Examiner* — Aaron R Eastman
(74) *Attorney, Agent, or Firm* — Oliff PLC

(57) ABSTRACT

A rotor blade 40 for a gas turbine engine has an aerofoil portion 42 from a root 48 to a tip 54. In use, combustion gas may leak over the tip 54 from the pressure face 52 to the suction face 50. A gutter 62 extends across the tip 54 to entrain any over tip leakage gap. The floor of the gutter defines an increased depth portion 72 at the exit end of the gutter 62.

15 Claims, 7 Drawing Sheets

BLADES

The present invention relates to rotor blades.

Rotor blades are used in gas turbine engines to interact with combustion gases to convert kinetic energy of the combustion gases into rotation of the rotor.

The efficiency of the engine is affected by the manner in which the combustion gases flow around the rotor blades.

Examples of the present invention provide a rotor blade having an aerofoil portion with a leading edge and a trailing edge, the blade further having a tip and a root, there being at least one gutter extending across the tip to an exit in the region of the trailing edge, and the gutter being defined, at least in part, by a floor, wherein the floor defines an increased depth portion of the gutter, at the exit end of the gutter.

The depth of the increased depth portion may be different at different positions along the increased depth portion toward the exit The increased depth portion may have a depth which increases progressively toward the exit.

The depth of the increased depth portion may increase progressively at an angle from a tangential plane of the blade, the angle increasing toward the exit. The depth of the increased depth portion may increase progressively at an angle from a tangential plane of the blade, the angle decreasing toward the exit. The depth of the increased depth portion may increase progressively at an angle from a tangential plane of the blade, the angle increasing toward the exit. The increased depth portion may include a region in which the depth decreases toward the exit.

The depth of the gutter, in the increased depth portion, may increase across substantially the whole width of the gutter.

Alternatively, the depth of the gutter, in the increased depth portion, may increase across part of the width of the gutter. The increased depth portion may be flared when viewed from the tip toward the root, to widen toward the exit.

The increased depth portion may extend up to about 80% of the length of the gutter, from the exit. Alternatively, the increased depth portion may extend up to about 50% of the length of the gutter, from the exit.

Examples of the present invention also provide a gas turbine engine characterised by comprising at least one rotor blade according to this aspect of the invention.

Examples of the present invention will now be described in more detail, with reference to the accompanying drawings, in which.

Figure 3:
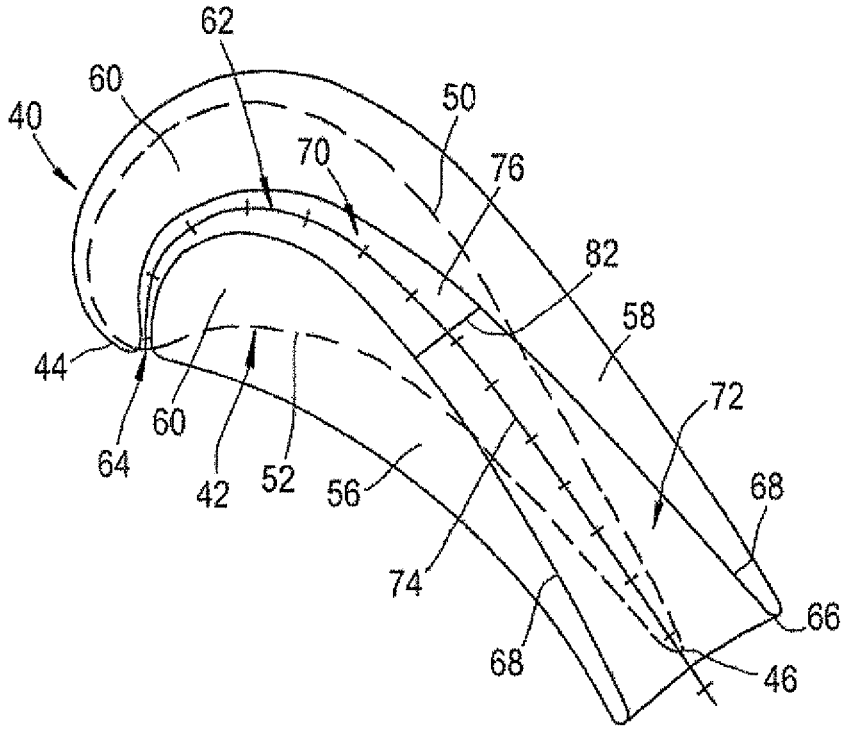
FIG. 3 is an end view of the turbine blade.
Figure 4:
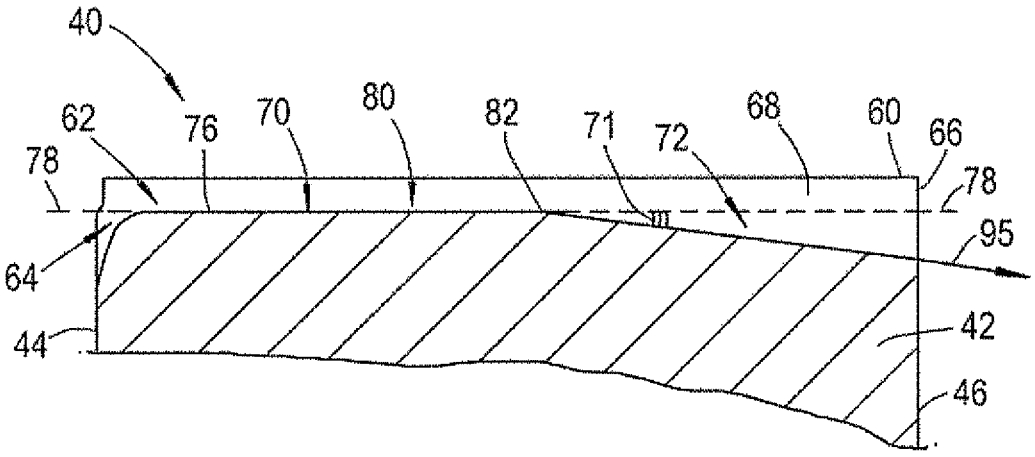
FIGS. 4 and 5 are partial sections of the tip of the turbine blade.
Figure 5:
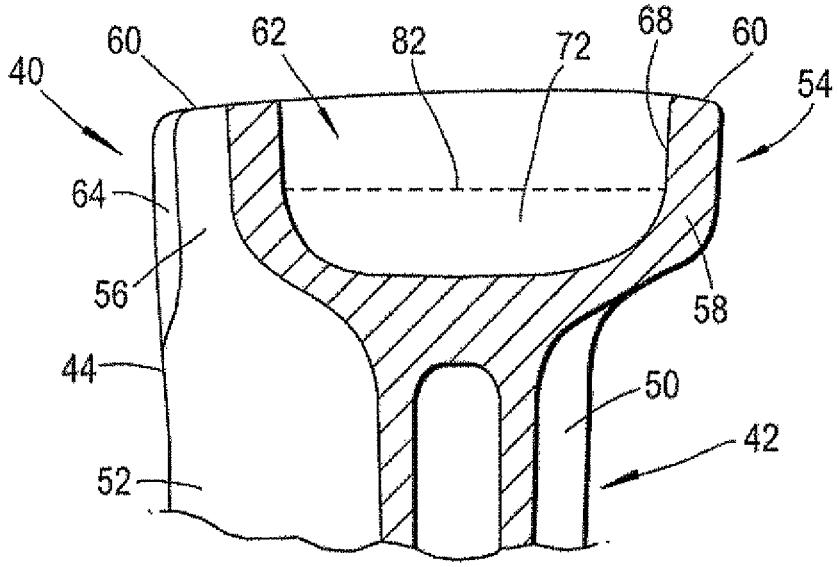
Figure 9:
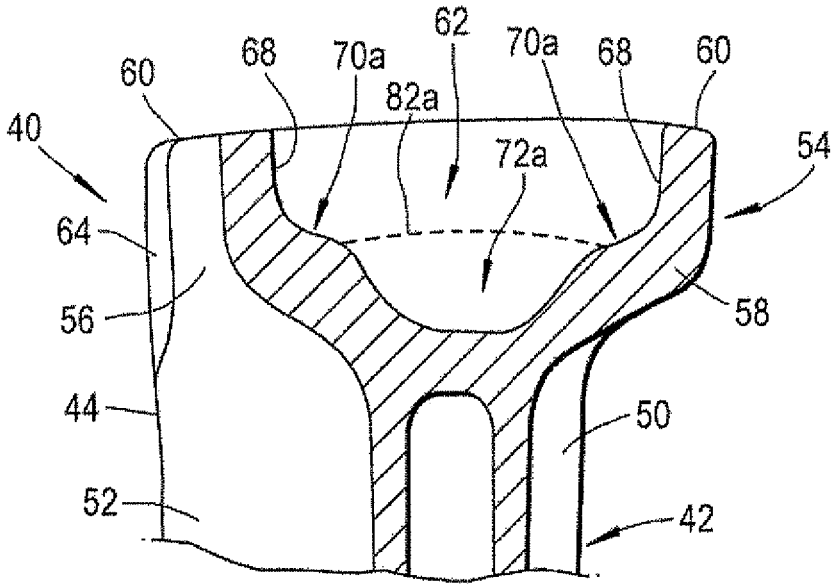
Figure 6A:
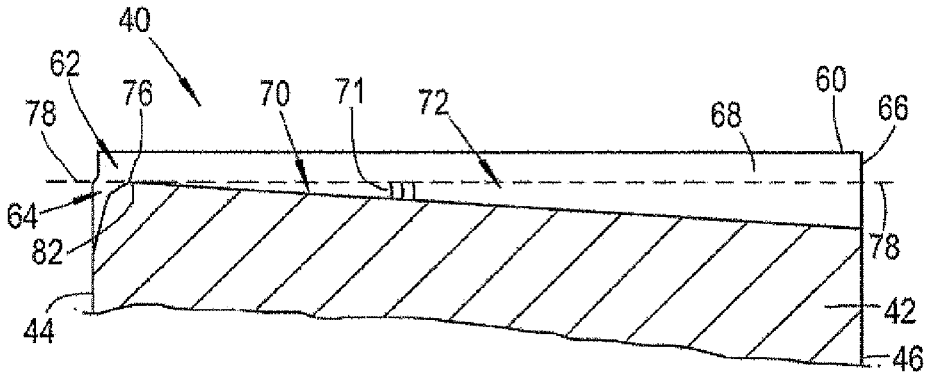
Figure 6B:
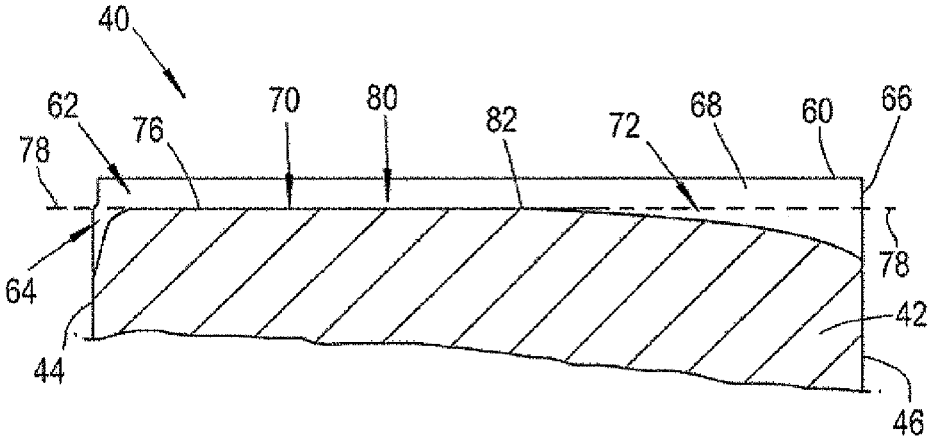
Figure 6C:
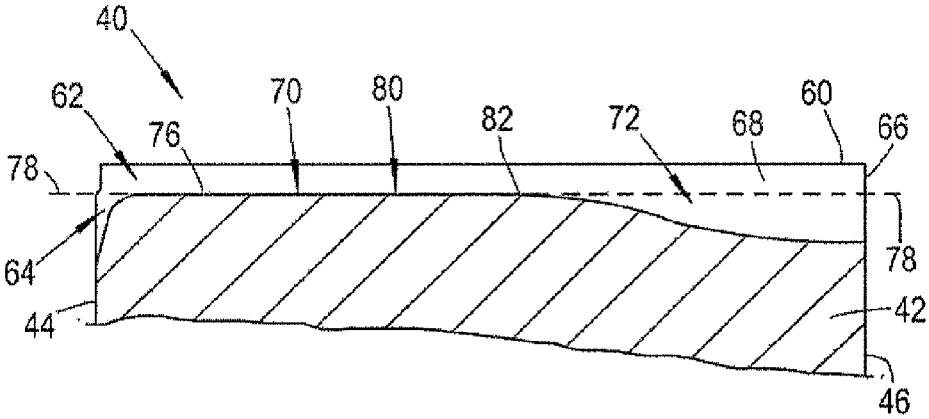
Figure 6D:
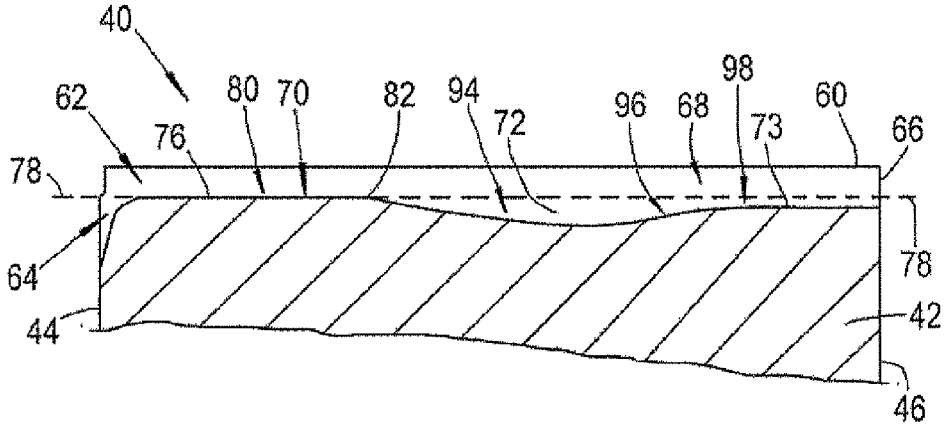
Figure 6E:
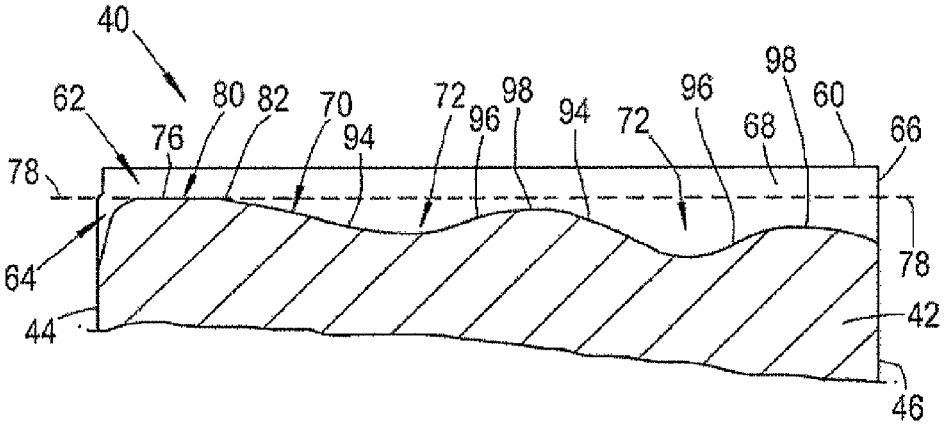
Figure 7:
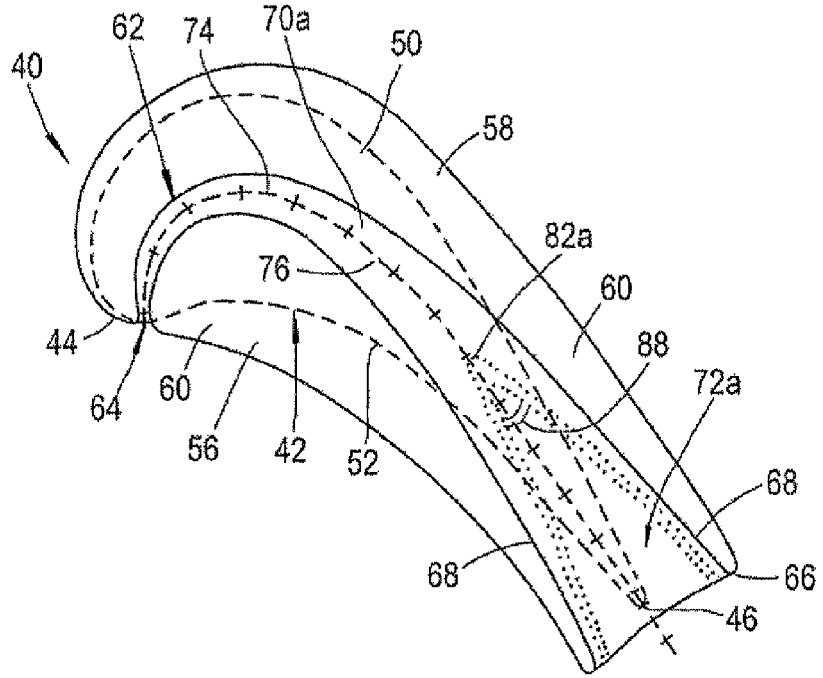
Figure 8:
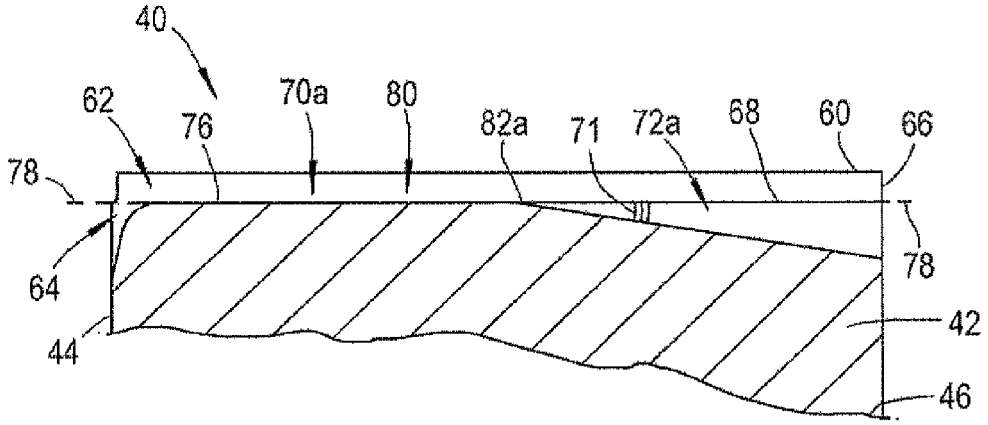

FIGS. 6*a* to 6*e* correspond with FIG. 4, showing other profiles for the gutter floor; and FIGS. 7, 8 and 9 correspond with FIGS. 3, 4 and 5, showing an alternative example.

Figure 1:
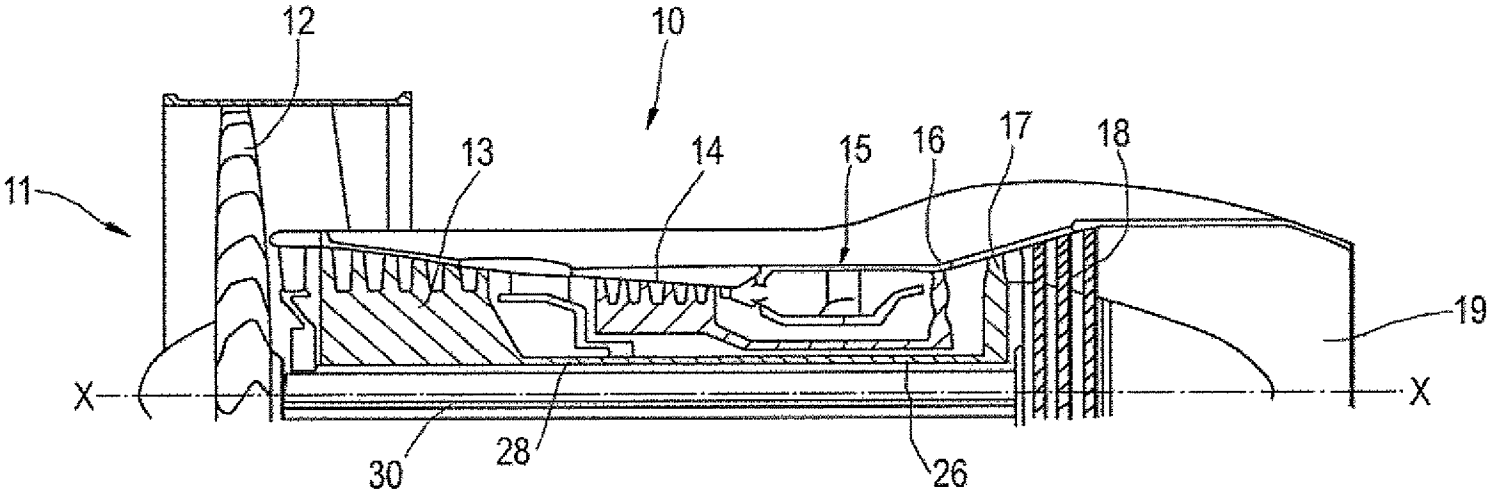
FIG. 1 is a section through an example gas turbine engine with which the present invention may be used.

Referring to FIG. 1, a gas turbine engine is generally indicated at 10 and comprises, in axial flow series, an air intake 11, a propulsive fan 12, an intermediate pressure compressor 13, a high pressure compressor 14, a combustor 15, a turbine arrangement comprising a high pressure turbine 16, an intermediate pressure turbine 17 and a low pressure turbine 18, and an exhaust nozzle 19.

The gas turbine engine 10 operates in a conventional manner so that air entering the intake 11 is accelerated by the fan 12 which produce two air flows: a first air flow into the intermediate pressure compressor 13 and a second air flow which provides propulsive thrust. The intermediate pressure compressor compresses the air flow directed into it before delivering that air to the high pressure compressor 14 where further compression takes place.

The compressed air exhausted from the high pressure compressor 14 is directed into the combustor 15 where it is mixed with fuel and the mixture combusted. The resultant hot combustion products then expand through, and thereby drive, the high, intermediate and low pressure turbines 16, 17 and 18 before being exhausted through the nozzle 19 to provide additional propulsive thrust. The high, intermediate and low pressure turbines 16, 17 and 18 respectively drive the high and intermediate pressure compressors 14 and 13 and the fan 12 by suitable interconnecting shafts 26, 28, 30.

The efficiency of the engine is affected by the manner in which the combustion gases flow around the rotor blades, as noted above. For example, a recognized problem exists, arising from leakage of combustion gases between the rotating tip of the turbine blades and the stationary casing which surrounds them. This leakage is sometimes called "over tip leakage".

The following examples seek to address problems associated with over tip leakage.

Figure 2:
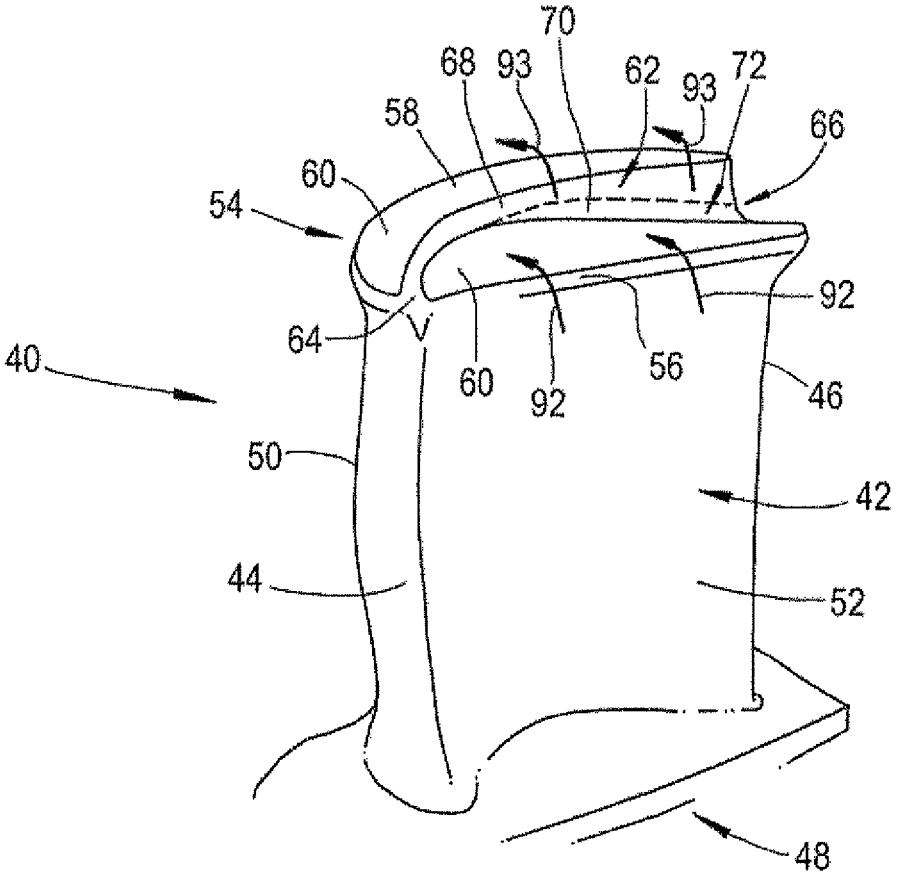
FIG. 2 is a perspective view of a turbine blade for the engine.

FIG. 2 illustrates a single rotor blade 40 for use in one of the turbines 16, 17, 18 of the gas turbine engine 10. The blade 40 has an aerofoil portion 42 which interacts with combustion gases passing through the turbine. The aerofoil portion 42 has a leading edge 44 and a trailing edge 46. A root 48, which may be shrouded, provides for mounting the blade 40 on a rotor disc (not shown) in conventional manner. The aerofoil portion 42 has a suction face 50 and a pressure face 52. The aerodynamic form of the portion 42 creates aerodynamic lift, which in turn creates rotation in the turbine, thus turning the turbine disc.

The blade 40 has a tip 54 which is at the radially outer end of the blade 40, when the turbine is rotating. The tip 54 carries winglets 56, 58 which project laterally from the blade 40, at the radially outer end of the suction face 50 and pressure face 52, respectively. The winglets provide an end face 60 to the blade 40.

A gutter 62 extends across the tip 54. That is, the gutter 62 is provided across the end face 60. The gutter 62 extends from a mouth 64 in the region of the leading edge 44, to an exit 66 in the region of the trailing edge 46. The gutter 62 is open at the end face 60 and is defined between side walls 68 and by a floor 70. The floor 70 defines an increased depth portion 72 of the gutter 62, at the exit end of the gutter 62.

In this example, the width of the gutter 62 increases progressively from the mouth 64 to the exit 66 (FIG. 3). The side walls 68 are substantially equally spaced to either side of the mean camber line 74 of the aerofoil portion 42. The mean camber line 74 is the line of points which lie equidistant from the suction face 50 and the pressure face 52, at any position along the aerofoil portion 42, between the leading edge 44 and the trailing edge 46. Accordingly, the centre line of the gutter 62 is substantially coincident with the mean camber line 74. Other arrangements are possible.

The profile of the floor 70 can be understood from FIG. 4, which is a section along the centre line of the gutter 62, which may also be the mean camber line 74. In this example, the floor 70 is rounded in the vicinity of the mouth 64, to blend smoothly with surrounding surfaces and reduce the risk of undesirable vortices being created by gas flowing over discontinuities. Other shapes could be used for the mouth 64.

Further down the gutter 62, the floor has a flat portion 76 which is substantially perpendicular to the radial direction of the blade 40. That is, the flat portion 76 lies substantially parallel with a plane 78 which is perpendicular to the radial direction and can therefore be called a tangential plane.

The flat portion 76 defines a first part 80 of the gutter 62 which is of constant depth. The flat portion 76 finishes at an edge 82. In this example, the edge 82 is approximately halfway down the gutter 62 from the mouth 64 to the exit 66. That is, the flat portion 76 extends over approximately 50% of the length of the gutter 62. In other examples, the flat portion 76 may extend over as little as 50% or as much as 80% of the length of the gutter 62. In this respect, the reader's attention is drawn to the other variations and examples described below and illustrated in other drawings.

The edge 82 marks the transition between the constant depth portion 80, and an increased depth portion 72. In the examples being described, the maximum depth of the gutter 62 is greater in the increased depth portion 72 than in the constant depth portion 80. In this example, the increased depth results from the floor 70 falling away from the edge 82 toward the exit 66. Thus, the depth of the increased depth portion is different at different positions along the increased depth portion. In this example, the floor 70 falls away at a substantially constant angle 71 from the tangential plane 78, and the depth increases progressively. Other possibilities are described below.

In this example, the edge 82 extends across the whole width of the gutter 62, between the side walls 68. Thus, the increased depth portion 72 has a depth greater than the constant depth portion 80, across substantially the whole width of the gutter 62. This can be seen from FIG. 5, which shows the profile of the gutter 62, near the exit 66.

Various variations of the example illustrated in FIGS. 2 to 5 are illustrated in FIGS. 6*a* to *e*. Many features are the same as those described above, particularly in relation to FIG. 4, and are therefore given the same reference numerals again. These additional variations are illustrated to explain other forms in which the depth of the increased depth portion can be arranged to be different at different positions along the increased depth portion.

In FIG. 6*a*, the position of the edge 82 is closer to the mouth 64 than in FIG. 4, resulting in the flat portion 76 having little or no length along the gutter 62. In common with FIG. 4, the floor 70 falls away at a substantially constant angle 71 from the tangential plane 78.

In FIG. 6*b*, the edge 82 is closer to the exit 66 than in FIG. 6*a*. The angle at which the floor 70 falls away is not constant, but increases toward the exit 66, giving the floor 78 a curved profile which is convex.

In FIG. 6*c*, the angle at which the floor 70 falls away decreases toward the exit 66, giving the floor 78 a curved profile which is concave.

In FIG. 6*d*, the angle at which the floor 70 falls away changes at different positions toward the exit 66, giving the floor 78 a profile which includes a concavity 94 and a region 96 in which the depth decreases toward the exit 66. In a region 98, the depth is less than in regions further away from the exit 66.

In FIG. 6*e*, the angle at which the floor 70 falls away again changes at different positions toward the exit 66, as in FIG. 6*d* but in a more complicated manner. This gives the floor 78 a profile which includes various concavities 94 and various regions 96 in which the depth decreases toward the exit 66. In various regions 98, the depth is less than in regions further away from the exit 66.

Other variations could include sharp edges between regions of different depth, and different numbers and positions of transitions between depths.

An alternative example is illustrated in the remaining drawings. Many features are the same as those described above and are therefore given the same reference numerals again. Other features correspond closely with features described above and are therefore indicated with corresponding reference numerals, to which the suffix "a" has been added.

In this example, the floor 70 does not fall away across the whole width of the gutter 62, as can be seen from FIG. 7. The flat portion finishes at a point 82*a*. Initially, near the point 82*a*, the floor 70 falls away only near the centre line of the gutter, resulting in the increased depth portion 72*a* forming a narrow channel in the floor 70. In this example, the channel 72*a* becomes progressively deeper toward the exit 66, as noted above. In addition, the channel 72*a* also becomes progressively wider toward the exit 66. That is, the channel 72*a* is flared from the point 82*a* toward the exit 66. Various different flare angles 88 can be used.

The profile of the floor 70, in the channel 72*a*, can be understood from FIG. 8, which is a section along the centre line of the gutter 62. It is apparent from the drawings that the profile shown in FIG. 8 is very similar to profiles illustrated in relation to the first example, particularly FIG. 4. That is because the principal difference between the examples relates to the flare in the channel, illustrated most clearly in FIG. 7. Any of the example profiles described above in relation to FIG. 4 or FIGS. 6*a* to 6*e* could be used in conjunction with a flared channel 72*a*.

FIG. 9 shows the profile of the floor 70 and channel 72*a*, near the exit 66. It can be seen that the width of the channel 72*a* is less than the width of the gutter 62, so that there are narrow portions of floor 70*a*, to either side of the channel 86. In other examples, the width of the channel 72*a* may be the same as the width of the gutter 62, at the exit 66. It can also be seen from FIG. 9 that all edges between the various surfaces defining the gutter 62 are rounded to encourage smooth gas flow.

The flared shape of the channel 72*a* results in the profile of the gutter 62 changing along the length of the gutter. Thus, near the point 82*a*, the floor of the gutter 62 will be largely flat, with a relatively narrow channel 72*a*, whereas, near the exit 66, the floor of the channel 72*a* will be wider. At the exit 66, the floor of the channel 72*a* will be the same or nearly the same width as the gutter 62.

The flare of the channel 72*a* also results in additional material being present under the floor area 70*a*, as compared with the profile of FIG. 5. This may be advantageous in strengthening the blade 40 and may allow other features to be provided in these regions, without conflicting with the gutter 62.

In use, a flow of combustion gas 90 is established across the aerofoil portion 42. Some tendency for over tip leakage can be expected, as noted above, by virtue of the pressure differences at the faces 50, 52. This is indicated schematically in FIG. 2 by arrows 92. The over tip leakage flow 92 will tend to be entrained by the gutter 62 to be redirected along the gutter 62, to the exit 66. As this entrained gas leaves the exit 66, it returns to the main combustion gas flow, in the vicinity of the trailing edge 46, while doing some useful work on the turbine.

The increasing depth of the gutter 62, nearer the exit 66, allows an increasingly large volume of gas to be accommodated in the gutter 62 without undue increase in the flow velocity as more of the leakage gases 92 are accumulated along the length of the gutter. Thus, the increased depth helps to reduce the risk of the gutter 62 becoming full of entrained gas which would result in further leakage from the gutter 62 over to the suction face 50 (as indicated by arrows 93 in FIG.

2), which would be expected to have a severely adverse effect on performance. The example shown in the drawings assume an increasing pickup of leakage flow 92 along the gutter length, and therefore provide a cross-sectional area of the gutter which increases along the length of the gutter, by virtue of the increasing depth and width of the gutter, to reduce or remove the requirement for an increase in the flow velocity along the gutter. The other illustrated variations indicate how the varying depth can be tuned to achieve optimal flow velocity at each point along the length of the gutter. This turning can be achieved by choosing the position of the edge 82 or point 82*a*, the angles and shapes with which the floor falls away toward the exit 66, the rate of flare (if any) of the increased depth portion, for example.

The smoothness with which the depth of the gutter 62 varies can also be tuned to minimise flow separation, which is penalising to performance.

In addition to tuning the cross-sectional area of the gutter by varying the depth to minimise over tip leakage, the dimensions of the gutter can be chosen to give the gas a slight inboard direction (toward the root 48) as it leaves the exit 66, as indicated by arrows 95 (FIG. 4). Controlling the speed and direction of the gas in this manner allows the discharged gas from the gutter 62 to fill more effectively the wake produced by the winglets 56, 58 and also to help limit radial migration of the main gas flow downstream of the blade 40. Furthermore, controlling the speed and direction of the gas also helps to reduce mixing losses arising as the outlet stream from the gutter 62 rejoins the main flow.

In each of the examples described above, the side walls 68 are approximately aligned with the radial direction of the blade 40 and are therefore approximately perpendicular to the floor 70. This is expected to help leakage gases 92 trip as they pass over the gutter 62, and therefore to mix more readily with the gas stream already moving along the gutter 62. Conversely, leakage of gas 93 from the gutter 62 over the tip 54, toward the suction face 50 will be reduced.

The reduction in over tip leakage gas, which is expected to result from these examples, can also help to reduce losses associated with over tip leakage gas mixing with scraping vortexes associated with the tip 54 "scraping" around the inside face of an outer casing, and with horseshoe vortexes which arise at the top and bottom of the leading and trailing edges 44, 46.

The turbine blades described above can be used in aero engines, marine engines or industrial engines, or for power generation.

The invention claimed is:

1. A rotor blade having an aerofoil portion with a leading edge and a trailing edge, the blade further having a tip and a root, there being at least one gutter extending across the tip to an exit in the region of the trailing edge, and the gutter being defined, at least in part, by a floor, wherein a first portion of the gutter comprises a cross-sectional area viewed from the trailing edge with a radial dimension that increases toward the trailing edge of the gutter, and a second portion of the gutter comprises a cross-sectional area viewed from the leading edge with a radial dimension that increases at the leading edge of the gutter.

2. A blade according to claim 1, wherein a depth of the first portion of the gutter is different at different positions along the first portion toward the exit.

3. A blade according to claim 2, wherein the depth of the first portion of the gutter increases progressively toward the exit.

4. A blade according to claim 3, wherein the depth of first portion of the gutter increases progressively at an angle which is substantially constant from a tangential plane of the blade.

5. A blade according to claim 3, wherein the depth of the first portion of the gutter increases progressively at an angle from a tangential plane of the blade, the angle increasing toward the exit.

6. A blade according to claim 3, wherein the depth of the first portion of the gutter increases progressively at an angle from a tangential plane of the blade, the angle decreasing toward the exit.

7. A blade according to claim 2, wherein the gutter includes a region in which the depth decreases toward the exit.

8. A blade according to claim 1, wherein the depth of the gutter, in the first portion, increases across a majority of the width of the gutter.

9. A blade according to claim 1, wherein the depth of the gutter, in the first portion, increases across part of the width of the gutter.

10. A blade according to claim 9, wherein the first portion of the gutter is flared when viewed from the tip toward the root, to widen toward the exit.

11. A blade according to claim 1, wherein the first portion of the gutter extends up to about 95% of the length of the gutter, from the exit.

12. A blade according to claim 1, wherein the first portion of the gutter extends up to about 50% of the length of the gutter, from the exit.

13. A gas turbine engine comprising at least one rotor blade according to claim 1.

14. A blade according to claim 1, wherein the blade is a turbine blade.

15. A rotor blade having an aerofoil portion with a leading edge and a trailing edge, the blade further having a tip and a root, there being at least one gutter extending across the tip to an exit in the region of the trailing edge, and the gutter being defined, at least in part, by a floor, wherein a first portion of the gutter comprises a cross-sectional area viewed from the trailing edge with a radial dimension that increases toward the trailing edge of the gutter, and a second portion of the gutter comprises a cross-sectional area viewed from the leading edge with a radial dimension that increases at the leading edge of the gutter, and wherein a depth of the gutter increases toward the exit along a plane perpendicular to a radial direction of the blade.

* * * * *